US005678270A

United States Patent [19]

Mercalli et al.

[11] Patent Number: 5,678,270

[45] Date of Patent: Oct. 21, 1997

[54] DEVICE FOR POSITIONING AND BLOCKING SOLES AND MACHINE FITTED WITH SUCH DEVICE

[75] Inventors: Luciano Mercalli, Vigevano; Paolo Marazzi, Torlino Vimercati, both of Italy

[73] Assignee: Officine Meccanicme Cerim S.p.a., Vigevano, Italy

[21] Appl. No.: 398,963

[22] Filed: Mar. 2, 1995

[30] Foreign Application Priority Data

Apr. 21, 1994 [IT] Italy ..... MI94A0770

[51] Int. Cl.[6] ..... A43D 25/00; A43D 25/10

[52] U.S. Cl. ..... 12/17 R; 12/123

[58] Field of Search ..... 12/1 W, 122, 123, 12/17 R, 17.2, 142 F, 142 T; 156/580; 269/21, 45, 50

[56] References Cited

U.S. PATENT DOCUMENTS

| | | | |
|---|---|---|---|
| 2,598,688 | 6/1952 | Gulbrandsen | 12/123 |
| 3,166,771 | 1/1965 | Kline et al. | 12/123 X |
| 3,783,463 | 1/1974 | Von Schoppe | 12/123 X |
| 3,860,985 | 1/1975 | Von Schoppe | 12/17 R |
| 5,098,508 | 3/1992 | Mattil | 12/123 X |
| 5,264,069 | 11/1993 | Dietrich et al. | 12/123 X |
| 5,405,123 | 4/1995 | Mielenz | 269/21 |
| 5,572,786 | 11/1996 | Rensch | 269/21 X |

FOREIGN PATENT DOCUMENTS

| | | | |
|---|---|---|---|
| 2646328 | 11/1990 | France | 12/123 |

*Primary Examiner*—B. Dayoan
*Attorney, Agent, or Firm*—Robert W. J. Usher

[57] ABSTRACT

A device for positioning and blocking soles of footwear includes a table (26, 32) with an area for resting the sole, members (28, 29, 39, 40) for centering the sole disposed at least at opposite ends of the rest area and a vacuum operated device (44, 45) which suction the sole against the table to maintain it in the position imposed by the centering members. The adaptability of the work surface and the positioning members, together with the replaceability of the suction fixtures (46, 47) disposed on the work surface enable the correct positioning and blockage of soles of various shapes. A machine (53) incorporating the device can thus operate on a sole quickly and efficiently, for example to spread glue on its surface to be stuck onto a corresponding shoe.

25 Claims, 4 Drawing Sheets

DEVICE FOR POSITIONING AND BLOCKING SOLES AND MACHINE FITTED WITH SUCH DEVICE

BACKGROUND OF THE INVENTION

This invention refers to an innovative device for positioning and blocking soles of footwear and to a machine for preparing the soles, in particular for spreading glue on them, fitted with such device.

In the field of shoe manufacturing with semiautomatic machinery, there are well-known problems deriving from the need to position the soles and hold them firmly in place during the operations carried out on them, due to the wide variety of soles which differ in shape, thickness, flexibility, size, heel configuration, etc.. The problem is further complicated by the fact that the upper surface of the sole must always remain fully accessible, so that it is possible to carry out the various operations on it, such as spreading it with glue.

In the known technique, use is generally made of clamping vices composed of two opposing jaws sliding along a surface to block the sole by means of a direct action between heel and toe, the sole remaining resting on the sliding surface. The jaws are shaped so as to center the sole during clamping so that it is blocked in the pre-established working position.

A clamping system of this kind however suffers from various drawbacks. In fact, in the case of soles with a relatively high degree of flexibility, the clamping action causes the sole to curve upwards and possibly slip out of the clamping members. For soles with a high degree of elasticity this causes the sole to suddenly "shoot" out of the jaws with the same force that in theory should keep it firmly blocked.

The difficulty of blocking the sole is further heightened in the case of soles with a relatively slanted heel, on which the rear jaw can easily slip, or with a very high, slim heel, as is often the case with women's footwear. Moreover, especially in the case of thin soles, the upper part of the jaws protrudes from the edge of the sole, and consequently hampers the work. During the glue-spreading operations, the protruding portion of the jaw is easily smeared with glue, resulting in problems of cleaning and undesirable adhesion of the sole to the jaws.

Although variously-shaped jaws have been proposed in an attempt to at least partially obviate the clamping problems, each shape can only be used with a limited variety of soles, and consequently needs to be replaced each time the type of sole to be worked changes, resulting in a considerable loss of time by the operators.

The general scope of this invention is to obviate the aforementioned problems by providing an innovative device for positioning and blocking the soles of footwear, which guarantees that the sole is always correctly and firmly positioned with respect to the working tools, whatever the shape and thickness of the sole. Moreover, a machine is provided for working the soles, which is fitted with such blocking device.

SUMMARY OF THE INVENTION

This scope is achieved, according to the invention, by providing a device for positioning and blocking a footwear sole, comprising a table with a rest area for the sole, means for centering the sole disposed at least at opposing ends of the rest area and vacuum operated means which suction the sole against the table to maintain it in the position imposed by the centering means.

A machine is also provided for treating the soles of footwear, comprising a positioning and blocking device according to the invention and at least one tool movable along a pre-established path to carry out a pre-established operation on the surface of a sole in the device.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figure 1:
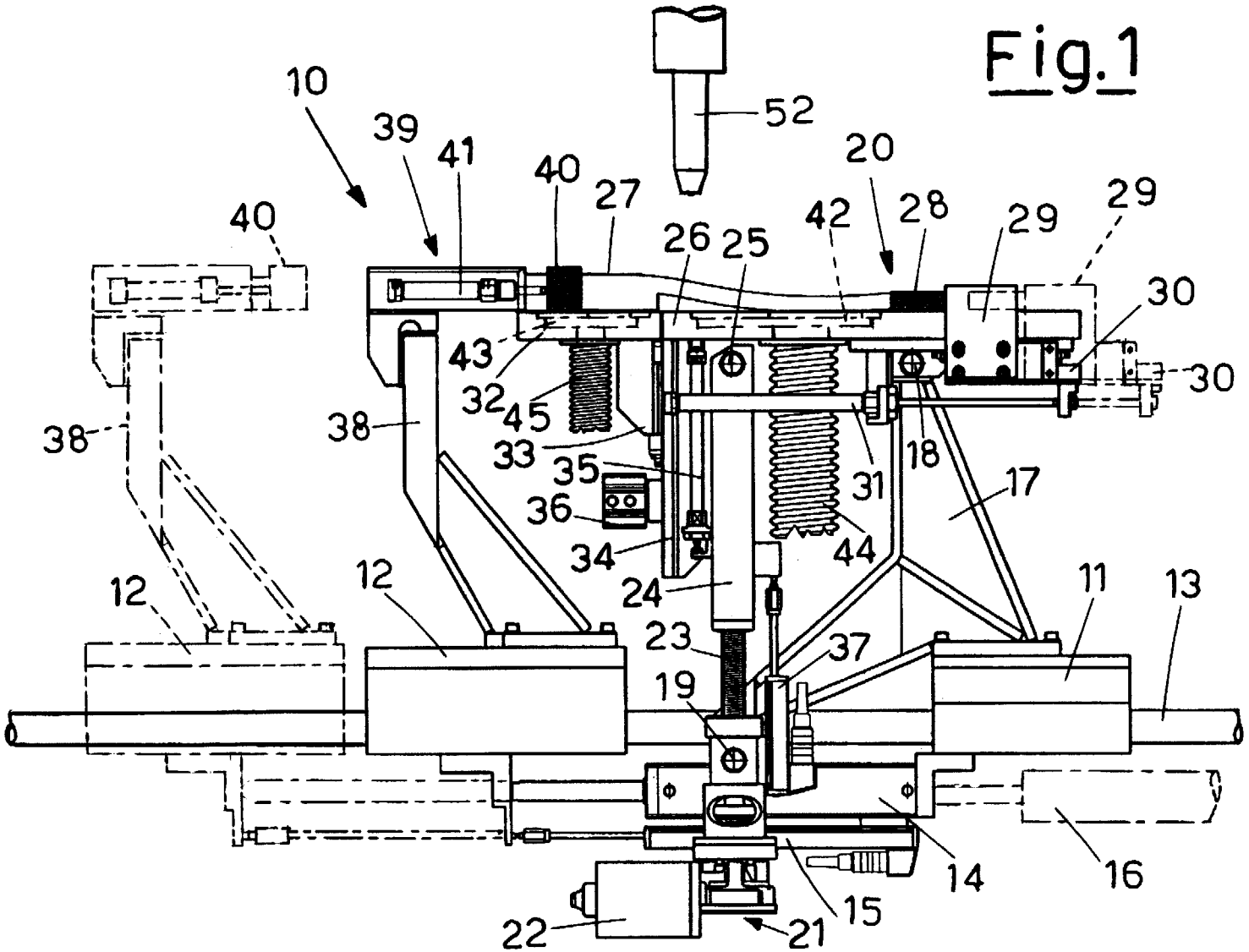
FIG. 1 shows a side scrap view of a machine with the blocking device according to the invention.

With reference to the figures, FIG. 1 shows a device according to the invention for blocking a sole in a pre-established position with respect to the tools 52, for example glue dispensing nozzles. The positioning and blocking device, generically indicated by reference 10, comprises two saddles 11, 12 sliding along guides 13. The saddles 11 and 12 are interconnected by means of a linear actuator 14, such as for example a pneumatic cylinder, associated with a relative position sensor 15. The front saddle 11 can also comprise means for blocking its movement along the guides or means for controlled displacement with respect to the latter, generically indicated by the broken line of reference 16.

The front saddle 11, integrally supports a frame 17 which in turn supports a blocking assembly 20; comprising a table or plate 26 defining an area for resting a sole 27 to be blocked.

To the front of the plate, and consequently close to the toe area of the sole, the plate supports a first centering block or locator 28, sliding parallel to the table by means of a supporting saddle sliding along guides 30 parallel to the length of the table and integral thereto. The saddle 29 is moved by an actuator 31, for example a pneumatic piston, acting between the plate and carriage to shift the centering block between a first clamping position and a second non-operative position shown respectively by the continuous line and the broken line in FIGS. 1 and 2.

The table 26 has a rear section 32 which is movable parallel to and perpendicular to the front portion of the table, by means of a supporting saddle 33 sliding along guides 34 secured to the front table.

The plate 32 is elastically pushed upwards by means of a pneumatic spring 35 so as to have its upper surface substantially aligned with the upper surface of the front table 26. As will be explained further on, the movement of the rear plate 32 along the guides 34 can be blocked in any position along the guides by means of a controllable braking device 36, for example a known electromagnetic brake.

Advantageously, the blocking assembly 20 is connected to the frame 17 of the front saddle 11 by means of an upper pivot 18 with an axis of rotation perpendicular to the sliding direction of the saddle along the guides. The assembly 20 is supported and shifted around the axis 18 by means of a drive unit 21 pivoted between an axle 25 integral with the table 26 and a lower axle 19 integral with the frame 17. For example, the drive unit comprises a motor 22 which controls a screw 23 on which slides a nut screw 24 pivoted from above by 25 to the blocking assembly 20. Disposed between the screw 23 and nut screw 24 is a relative position sensor 37 indicating in substance the degree of inclination of the assembly 20 around the axis 18.

The saddle 12 supports a frame 38 above which is secured a rear centering assembly 39 comprising a rear centering block or locator 40, movable between a forward or centering position and a withdrawn or non-operative position (shown by the broken line in FIG. 2) by means of an actuator 41. The entire assembly 39 can be advantageously movable between an operative position and a non-operative position (shown by the broken line in FIG. 1) by means of the actuator 14.

Figure 2:
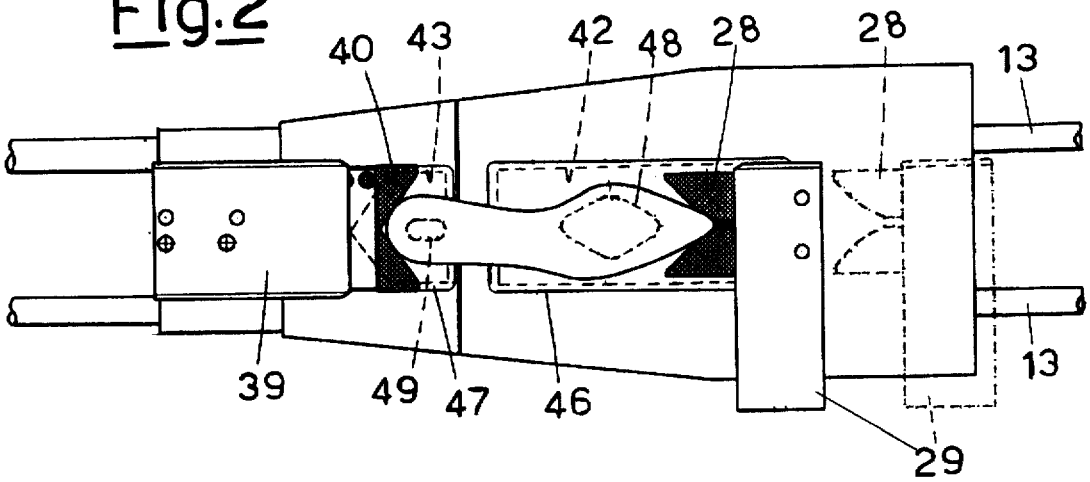
FIG. 2 shows a plan view of the device of FIG. 1.

As can also be seen in FIG. 2, the centering blocks 28 and 40 are generically V-shaped to partially receive the toe and heel of the sole when shifted into their operative position, in a direction substantially coinciding with the length of the sole, so as to provide an action of centering and positioning the sole placed on the table. The centering blocks can be replaceable or have arms of the V adjustable in position to adapt to very different shapes of soles.

As can be seen by the broken line in FIG. 1 and in FIG. 2, the plates 26, 32 each have a vacuum section or suction on their upper surface for the heel and toe area of the sole. These sections are achieved by means of respective rectangular exhausts 42, 43, provided on the upper surface of the plates 26 and 32 and connected from below to a source of vacuum composed of flexible suction ducts 44, 45, in turn connected to a known air suction pump, easily imaginable by the expert in the field and therefore not shown or further described.

Each exhaust 42, 43 forms a housing for a complementary removable plate or mask 46, 47 having a shaped aperture 48, 49.

Figure 3:
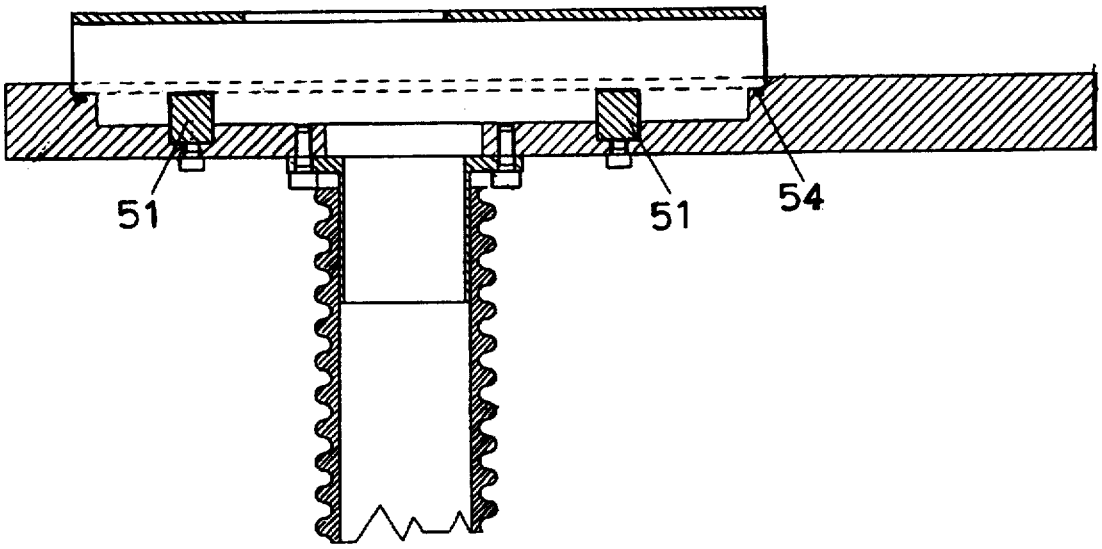
FIG. 3 shows an exploded cross-sectional view of a detail of the device of FIG. 1.

As can be seen in FIG. 3 for one of the vacuum sections (the other being substantially identical), the mask housed in the exhaust (for example made from relatively thin sheet metal) is fitted into a peripheral groove in the exhaust with interposition of a gasket 50. Removable coupling means hold the plate in place. For example, by making the mask at least partially from ferromagnetic material, it is conceivable to secure magnets 51 to the inside of the exhaust, to which the mask adheres when fitted into its housing. The plate can thus be easily removed by gripping it through the central passage and pulling.

As can be clearly seen in FIG. 2, the patterns of the passages 48, 49 through the masks are shaped to adapt to the conformation of the sole to be worked on, so that the passages themselves are covered respectively by the toe area and the heel area of the sole. There will consequently be a plurality of masks, each mask being made with a passage suited to a particular type of sole conformation.

Figure 7:
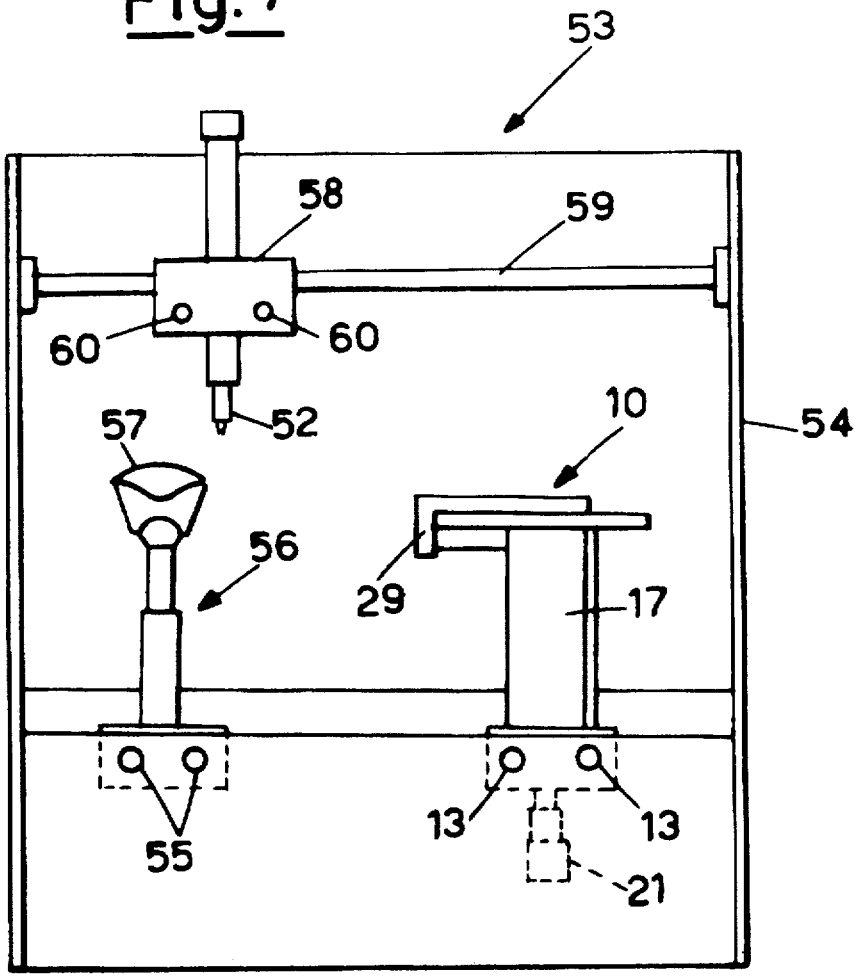
FIG. 7 shows a front view of a machine for working soles and uppers made according to the invention.

By way of example, FIG. 7 shows a machine using the positioning and blocking device described above. The machine, generically indicated by reference 53, comprises a frame 54 supporting guides 13 for movement of the device 10. Disposed above the device 10 is a cartesian device for driving the tool 52, for example a known glue spreading element. For example, the drive device comprises a saddle 58, sliding along crosswise guides 54 and supporting longitudinal guides 60 along which slide the working tool 52, which can also move vertically.

In this way, the end of the tool can be moved by the appropriately pre-programmed drive device along the surface of the sole supported by the device 10. The drive device is of known technique and is therefore not further described or shown herein.

Advantageously, disposed at the side of the device 10 is a support 56, movable along guides 55 parallel to the guides 13, supporting a shoe 57 which must be fitted with the sole placed in the device 10. In this way, a single tool 52 can spread glue both on the bottom of the shoe and on the bottom of the sole. As will be seen hereunder, the innovative features of the device 10 offer the possibility of regulating the position of the sole with the necessary precision, so that the same tool can follow both the contour of the shoe and the contour of the sole.

With reference to FIGS. 1 and 2, during a phase of preparing a particular model of sole for treatment, perforated masks 46 and 47, with suction passages set in the positions and with a shape suitable to be covered by the particular sole, are fitted in their respective housings.

The actuator 14 is operated so that the saddles 11 and 12 take up their reciprocal positions to allow the longitudinal positioning of the sole with the heel resting on the plate 32 and the internal end of the heel a few millimeters from the beginning of the front plate 26. In particular, the reciprocal position of the saddles is adjusted so that when the actuators controlling the centering blocks shift the blocks into position towards the sole, the heel and toe of the sole fit into the corresponding V-shaped grooves, as can be clearly seen in FIG. 2.

Figure 4:
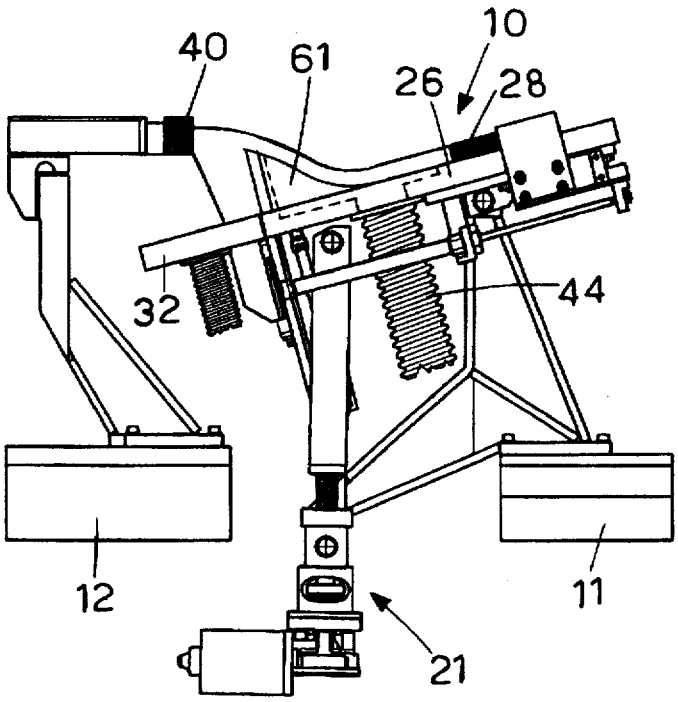
FIG. 4 shows a schematic scrap view of the device of FIG. 1, in a first operating condition.

As can be seen in FIG. 4, if the sole to be treated has a high heel and slopes sharply, the actuator 21 is operated to incline the resting surface of the sole so that the surface of the sole which is to be treated still remains with its heel portion in correspondence with the rear centering block and consequently with its heel area and toe area substantially at the same height. As can also be seen in FIG. 4, whenever the waist of the sole arches above the resting surface, the front mask can have a body 61 shaped in such a way as to still follow the shape of the sole and support it. The body 61 can also be perforated to constitute an extension of the suction duct, as shown by the broken line in FIG. 4.

Figure 5:
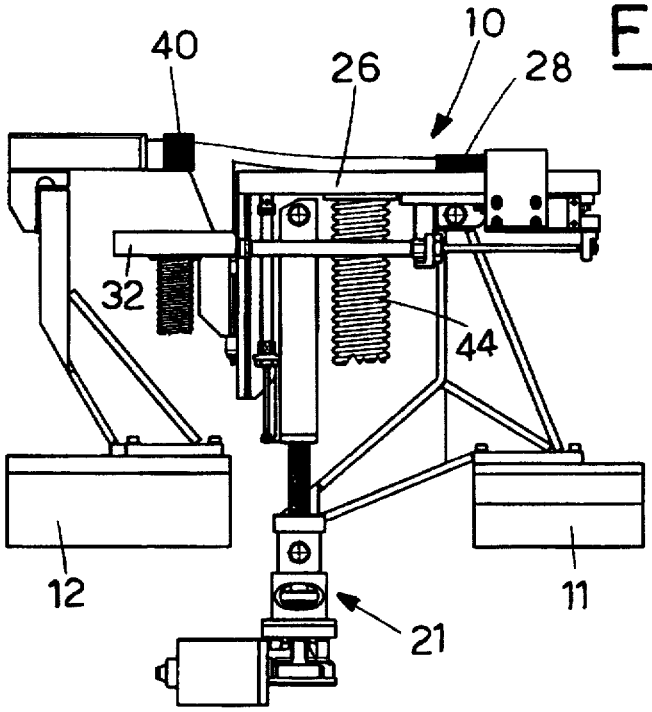
FIG. 5 shows a schematic scrap view of FIG. 1, in a second operating condition.

As shown in FIG. 5, in the case of soles which are sufficiently flexible to be easily flattened out to substantially adhere to the resting surface 26, it is possible to use the alternative solution shown in FIG. 5, in which the rear movable plate 32 is lowered to receive the heel. The operator can press the specimen sole against the front plate, so as to lower the rear plate by the correct degree and then operate the means blocking the rear plate to keep it firmly secured in the required position. Once the adjustment has been carried out it can be maintained throughout the treatment of all the soles of the same type.

After having carried out all the adjustments which, if required, can be stored in the memory of the machine so as to be quickly recalled each time the type of sole is changed, the machine is ready for use. The path that the tool must follow to carry out the required operations on the sole is also stored in the memory of the machine, by known techniques.

During use, initially the rear block is in its forward position while the front block is in the non-operative position shown by the broken line in FIG. 1, shifted away from the area on which the sole rests. The operator inserts the sole for which the machine has been set up, so that it rests on the supporting surface between the centering blocks, with its heel pressed against the rear block. At this point the working cycle is started up (manually by the operator or by a known sensor which detects the presence of the sole).

The front block is moved towards the sole by means of its motorized saddle, so that the sole is centered by the combined action of the two V-shaped blocks into which it fits. Once the blocks have reached their close-up position (the front block being controlled in position to prevent the two blocks from gripping the sole in such a way as to push it out of shape), the source of vacuum sucks air through the passages in the masks on which the sole is resting. The sole is thus blocked against the plate due to the vacuum that is created and the centering blocks can be shifted away by operating the saddle 29 and the actuator 41.

At this point the tool 52 can carry out its preprogrammed cycle with the assurance that the sole is firmly held in the pre-established position.

On completion of the work, the source of vacuum is switched off and the released sole can be removed by the operator and replaced with a new one.

To facilitate the introduction and removal of the soles by the operator, a movement of the actuator 16 can also be provided to shift the device 10 towards the front part of the machine during the operations of loading and unloading the soles.

In the event of the machine also comprising a support for the footwear, as shown in FIG. 7, while the operator loads or unloads the sole, the tool can carry out the operations on the bottom of the footwear, and while the operator loads or unloads the footwear, the tool can carry out the operations on the sole, thereby minimizing idle times.

Thanks to the flexibility of the device 10, which can position the sole with the same inclination as the footwear, it is possibile to alternately operate with the same tool on the sole and the footwear with the greatest of ease.

Figure 6:
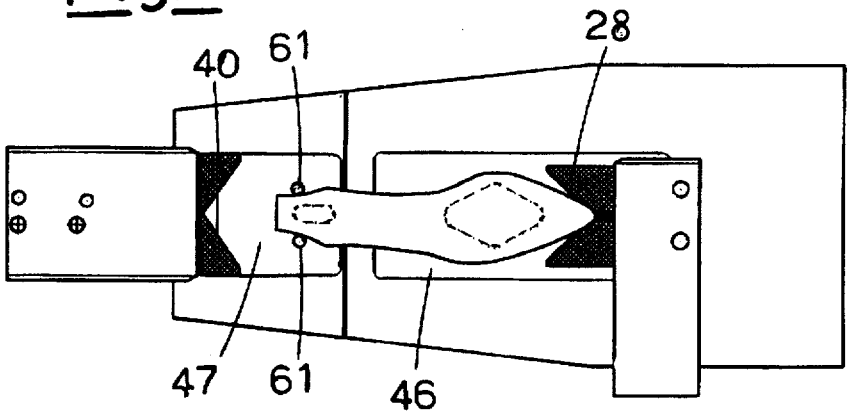
FIG. 6 shows a plan scrap view of a variation of the device of FIG. 1.

FIG. 6 shows a possible variation to carry out the centering of particular soles, for example with "Louis" heels, for which the rear V-shaped block is inefficient. As can be seen in this figure, the rear mask is made with protrusions or pins 61 between which the rear portion of the sole is inserted, thereby replacing the function of the rear block which can be permanently shifted to its non-operative position.

At this point it will be clear that the intended scopes have been achieved by providing a highly adaptable sole centering and blocking device whereby it is possible to construct machines which can handle the most diverse types of soles, switching rapidly and easily from one type to another. The combination between blocking by vacuum and centering mechanisms which do not subject the sole to mechanical stress by a clamping action, offers the possibility of centering and blocking soles of any thickness and flexibility, which is impossible with the known methods. Moreover, any hindrance to the movement of the tool operating on the sole is avoided, due to the fact that there are no blocking elements along the edge of the sole. For example, whenever the tools consist of glue dispensing nozzles, any possibility of smearing and possible adhesion of the sole to the clamping device is avoided.

The foregoing description of an embodiment applying the innovative principles of this invention is obviously given by way of example in order to illustrate such innovative principles and should not therefore be understood as a limitation to the sphere of the invention claimed herein. For example, the structure of the device can be simplified whenever any one of its possibilities of adaptation is not considered necessary. Thus, it can be made without the resting surface being divided into two parts or without being able to be tilted. Moreover, whenever the sliding movement of the entire device is not necessary, the front saddle can be omitted and the supporting frame 17 can be permanently secured to the structure of the machine. Whenever the tool is a glue dispenser, it can also be surrounded by a rotating spreading brush, as is known in the art.

What is claimed is:

1. Device for positioning and blocking a sole of a shoe, comprising a table with a rest area for the sole, mechanical means for centering the sole disposed at least at opposite ends of the rest area and vacuum operated means arranged to apply a vacuum to the rest area which suctions the sole against the table to maintain it in the position imposed by the centering means, the centering means comprising at least one centering element which is movable across the table from a position remote from the rest area in which it does not interfere with a sole in the rest area, to a position adjacent the rest area into centering engagement with the sole slidingly moving the sole across the rest area, and means for moving the centering element into centering engagement with the sole prior to operation of the vacuum operated means, and for moving the centering element away from the rest area during operation of the vacuum operated means to suction the sole against the table so that the sole remains held centered in the rest area solely by the suction of the vacuum operated means.

2. Device as claimed in claim 1, characterized by the fact that said at least one centering element is controlled to move by actuating means along a direction substantially coinciding with the length of the sole to interfere with end areas of the sole.

3. Device as claimed in claim 2, characterized by the fact that the centering element has a centering block with a substantially V-shaped jaw portion to receive and align one end of the sole.

4. Device as claimed in claim 1, characterized by the fact that centering elements are two in number, movable from opposite directions towards toe and heel areas of a sole in the rest area.

5. Device as claimed in claim 1, characterized by the fact that at least one centering element comprises an actuating saddle which is supported on a rest surface of the rest area.

6. Device as claimed in claim 1, characterized by the fact that at least one centering element comprises actuating means which are supported on a motorized saddle to move it away from a rest surface of the rest area.

7. Device as claimed in claim 4, characterized by the fact that a rest surface of the rest area is pivoted close to the toe area of the sole, so as to be tilted on command by tilting means with respect to the centering element close to the heel area.

8. Device as claimed in claim 7, characterized by the fact that the tilting means comprise a motorized screw assembly.

9. Device as claimed in claim 7, characterized by the fact that the rest surface comprises a rear portion designed to receive the heel of the sole, which is movable parallel to the remainder of the rest surface in a direction perpendicular thereto between a position aligned with the remainder of the rest surface and a position lower than the remainder of the rest surface.

10. Device as claimed in claim 9, characterized by the fact that the rear portion of the rest surface comprises means to push it elastically into said aligned position.

11. Device as claimed in claim 10, characterized by the fact of comprising means for blocking the movement of the rear portion of the rest surface in a position between the extremes of its movement.

12. Device as claimed in claim 1, characterized by the fact that the rest surface comprises suction passages in the sole rest area which are connected to a source of vacuum to create the vacuum means.

13. Device as claimed in claim 12, characterized by the fact that the suction passages open out on the rest surface through masks that can be removed from the table.

14. Device as claimed in claim 13, characterized by the fact that the removable masks are received in complementary recesses made in the table.

15. Device as claimed in claim 13, characterized by the fact that the removable masks are removably secured to the table by means of magnetic elements.

16. Device as claimed in claim 13, characterized by the fact that the removable masks are at least two in number, one in a heel rest area and one in a sole rest area of the sole.

17. Device as claimed in claim 16, characterized by the fact that the removable mask in the sole rest area has an upper shape substantially complementary to the waist area of the sole.

18. Device as claimed in claim 1, characterized by the fact that the centering means comprise at least one centering element which consists of protrusions projecting from a rest surface of the rest area.

19. Device as claimed in claim 13, characterized by the fact that the protrusions project from a sole engaging surface of the mask.

20. Device according to claim 1 further comprising at least one tool movable according to a pre-established path to carry out pre-established operations on an exposed surface of a sole in the device.

21. Device as claimed in claim 20, characterized by the fact that the positioning and blocking device is movably supported to move between a working position and a sole loading and unloading position.

22. Machine as claimed in claim 20, characterized by the fact of comprising a support for a shoe, the tool having motorized guides for its movement between the support and device to operate alternately on the bottom of the shoe fitted on the support and on the sole in said device.

23. Device as claimed in claim 20, characterized by the fact that the tool is a glue dispensing nozzle.

24. A device as claimed in claim 18, characterized by the fact that the protrusions project from the surface of a sole engaging mask.

25. Device for positioning and blocking a sole of a shoe, comprising a table with a rest area for the sole, means for centering the sole disposed at least at opposite ends of the rest area and vacuum operated means which suctions the sole against the table to maintain it in the position imposed by the centering means, a rest surface of the the rest area comprising a rear portion designed to receive the heel of the sole, which is movable parallel to the remainder of the rest surface in a direction perpendicular thereto between a position aligned with a remainder of the rest surface and a position lower than the rest surface.

* * * * *